United States Patent [19]

Thakrar et al.

[11] Patent Number: 4,832,615

[45] Date of Patent: May 23, 1989

[54] SEALED CONNECTOR HAVING UNITARY MOLDED HOUSING

[75] Inventors: Anil C. Thakrar, Camp Hill, Pa.; Robert G. Lundergan, Kernersville, N.C.

[73] Assignee: AMP Incorporated, Harrisburg, Pa.

[21] Appl. No.: 882,751

[22] Filed: Jul. 7, 1986

[51] Int. Cl.[4] ..... H01R 13/52

[52] U.S. Cl. ..... 439/272; 439/587

[58] Field of Search ..... 339/59 R, 59 M; 439/60 R, 60 M, 186 R, 186 M, 206 P, 94 R, 94 M, 61 R, 61 C, 61 M, 63 R, 63 M, 271-275, 278, 279, 587-589, 680

[56] References Cited

U.S. PATENT DOCUMENTS

| | | | |
|---|---|---|---|
| 2,881,406 | 4/1959 | Arson | 339/94 M |
| 3,059,210 | 10/1962 | Luenberger | 339/94 |
| 3,678,441 | 7/1972 | Upstone et al. | 339/94 R |
| 4,090,759 | 5/1978 | Hermann, Jr. | 339/60 M |
| 4,173,349 | 11/1979 | Neale | 339/60 C |
| 4,204,739 | 5/1980 | Shoenleben | 339/94 R |
| 4,293,182 | 10/1981 | Schwartz | 339/275 R |
| 4,311,355 | 1/1982 | Plyier et al. | 339/94 R |
| 4,443,048 | 4/1984 | Moist, Jr. | 339/63 M |
| 4,527,851 | 7/1985 | Gallusser et al. | 439/272 |
| 4,601,528 | 7/1986 | Spier | 339/91 R |
| 4,621,883 | 11/1986 | Noguchi | 439/278 |
| 4,639,061 | 1/1987 | Muzslay | 339/59 M |
| 4,640,567 | 2/1987 | Lundergan et al. | 339/94 M |
| 4,664,461 | 5/1987 | Schubert et al. | 339/59 M |
| 4,676,575 | 6/1987 | Denlinger et al. | 439/271 |

FOREIGN PATENT DOCUMENTS

| | | |
|---|---|---|
| 2038755 | 9/1971 | Fed. Rep. of Germany . |
| 968707 | 6/1961 | United Kingdom . |
| 2068654 | 8/1981 | United Kingdom . |

OTHER PUBLICATIONS

General Motors "Metri-Pack" Publication (6/83) p. A-24.

U.S. Patent Application Ser. No. 453,327, filed 12-2-7-82.

U.S. Patent Application Ser. No. 862,902, filed 5-13-86.

U.S. Patent Application Ser. No. 854,719, filed 4-16-86.

U.S. Patent Application Ser. No. 928,084, filed 11-7-86.

*Primary Examiner*—Gil Weidenfeld

*Assistant Examiner*—P. Austin Bradley

*Attorney, Agent, or Firm*—Robert W. Pitts

[57] ABSTRACT

A dual molded seal electrical connector having deformable seals adhering to relatively rigid body portions establishes sealing integrity for individual pin and socket terminals joining corresponding conductors. An interface seal surrounds a cavity containing one terminal and receives a cylindrical protuberance on the other connector housing. The seal is deflected radially outward upon engaging a conical surface on the protuberance. The connector bodies comprise one-piece molded members formed sequentially of different materials in the same mold.

11 Claims, 8 Drawing Sheets

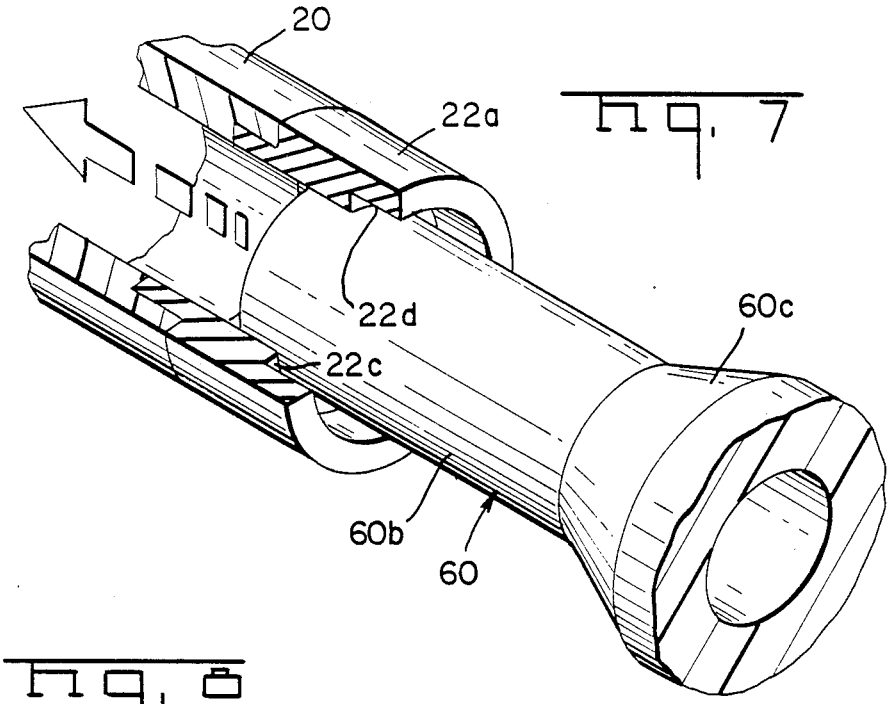
Fig. 7
Fig. 8
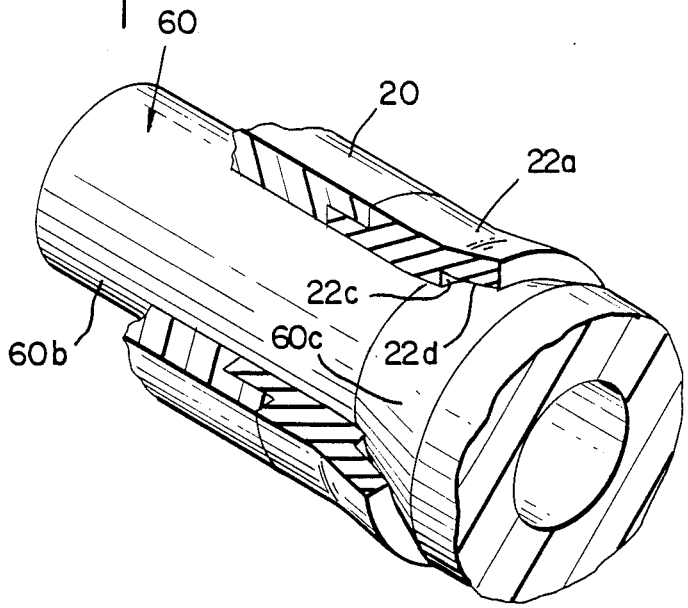

SEALED CONNECTOR HAVING UNITARY MOLDED HOUSING

BACKGROUND OF THE INVENTION

1. Field of the Invention

This invention relates to electrical connectors for establishing an environmentally sealed multiple contact interconnection with a plurality of conductors and more specifically to the dual molding of connectors having a rigid portion and a deformable sealing portion in a unitary insulative housing.

2. Description of the Prior Art

U.S. patent application Ser. No. 854,719 filed Apr. 16, 1986, now U.S. Pat. No. 4,640,567, a continuation of U.S. patent application Ser. No. 696,286, filed Jan. 30, 1985, now abandoned, discloses a multi contact sealed connector suitable for interconnecting a plurality of wires and providing seals to separately seal and isolate each individual terminal or circuit from the other circuits. Therefore, the sealing integrity of a single circuit does not affect the sealing integrity which can be maintained for other circuits or wires. Even if a particular terminal is removed from the connector housing, the remaining terminals and wires would still be sealed. The connector shown in that application employs discreet seals both to maintain sealing integrity with conductors and to maintain sealing integrity at the interface between two separate connector halves.

The use of separate discrete seals in the manner depicted in the above identified patent application means that care must be taken and time expended to handle and account for each seal during assembly of the product. The number of components in each electrical connector invariably adds to its cost of assembly. One technique for limiting the number of components in a sealed connector is disclosed in U.S. patent application Ser. No. 862,902, filed May 13, 1986, a Continuation In Part of U.S. patent application Ser. No. 453,327, filed Dec. 27, 1982. These patent applications disclose an electrical connector employing a one piece molded connector having a flexible sealing material chemically joined to a more rigid material of the type suitable for retaining and separating electrical contact terminals of the type normally used in detachable electrical connectors. The one piece housing depicted in the last two mentioned patent applications is formed by a dual molding process in which one material is first injected into a mold followed by the movement of core pins or sleeves to define one or more joining cavities into which the second material can be injected. The disclosure of each of the above mentioned pending patent applications is incorporated herein by reference.

SUMMARY OF THE INVENTION

The preferred embodiment of this invention comprises a sealed connector in which the matable plug and receptacle connector housings each constitute one-piece or unitary molded housings. Each housing, however, is formed of separate portions, molded in the same mold from different materials, and adhering to each other. The seals are relatively more deformable than the more rigid body portion and the seals establish sealing integrity with conductors entering the plug and receptacle and between the mated plug and receptacle. The receptacle housing body includes one or more cylindrical protuberances or silos which is insertable into a cavity on the plug housing. The mating seal is located on the receptacle, surrounding the cavity and the protuberance is inserted through the mating seal. A conical surface at the base of each protuberance engages the seal and expands the seal radially outward when the plug and receptacle are fully mated. Individual pin and socket terminals are located within the protuberances and cavities and the mating seal individually seals each circuit path formed by mating pins and sockets.

BRIEF DESCRIPTION OF THE DRAWINGS

FIG. 3 is a view similar to FIG. 2 in which the corresponding terminals and housing portions have been intermated and in which an interfacial seal on one housing component is shown in engagement with the other housing.

FIG. 8 is an enlarged perspective view of the portions of the silos mated with the interfacial seals.

FIG. 13 is a sectional view taken along section lines 13—13 showing the contour of the interface between the interfacial seal and the rigid body portion of the alternate embodiment.

DETAILED DESCRIPTION OF THE PREFERRED EMBODIMENT

Figure 1:
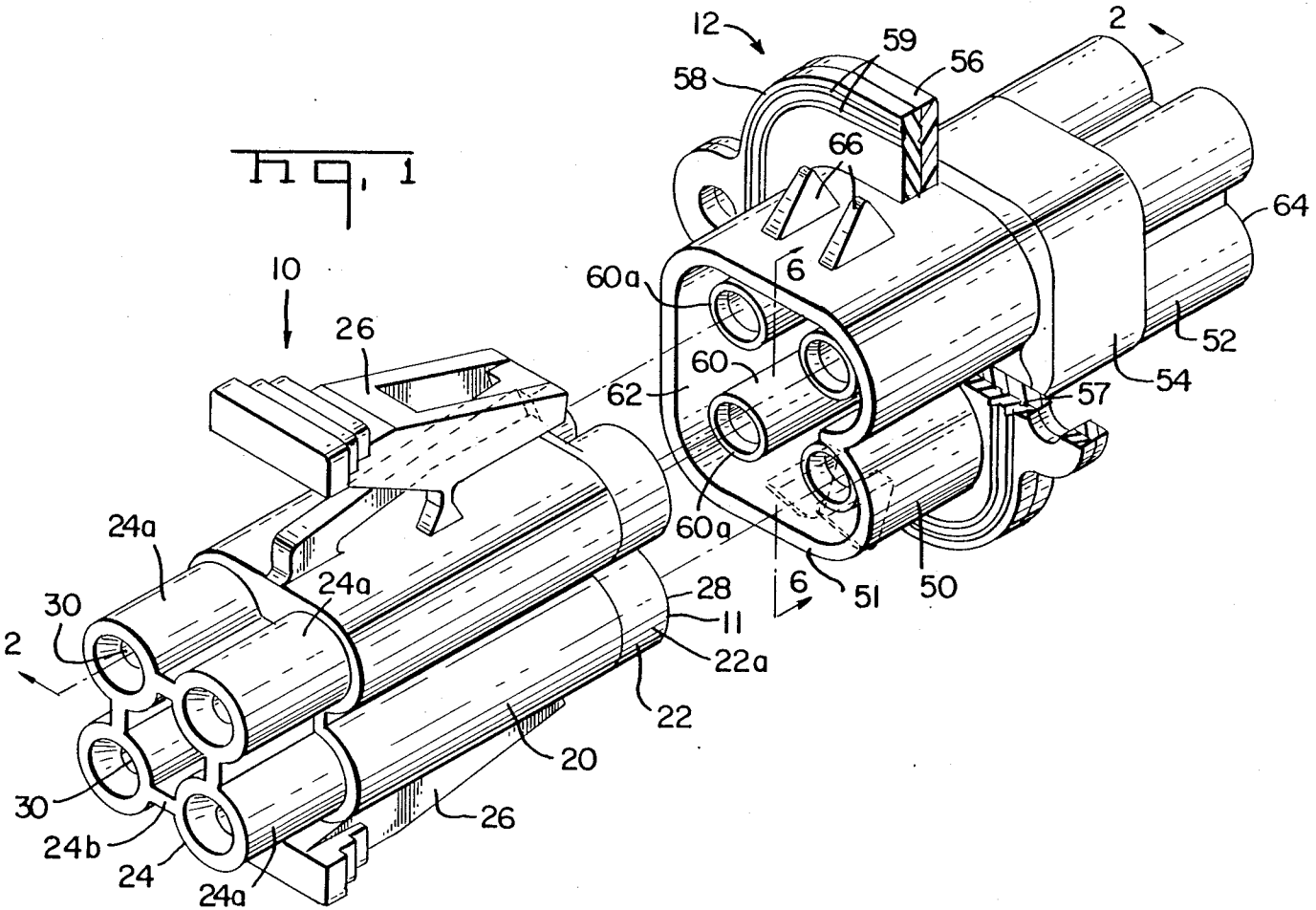
FIG. 1 is an exploded perspective view of a electrical connector assembly comprising two intermatable parts.
Figure 2:
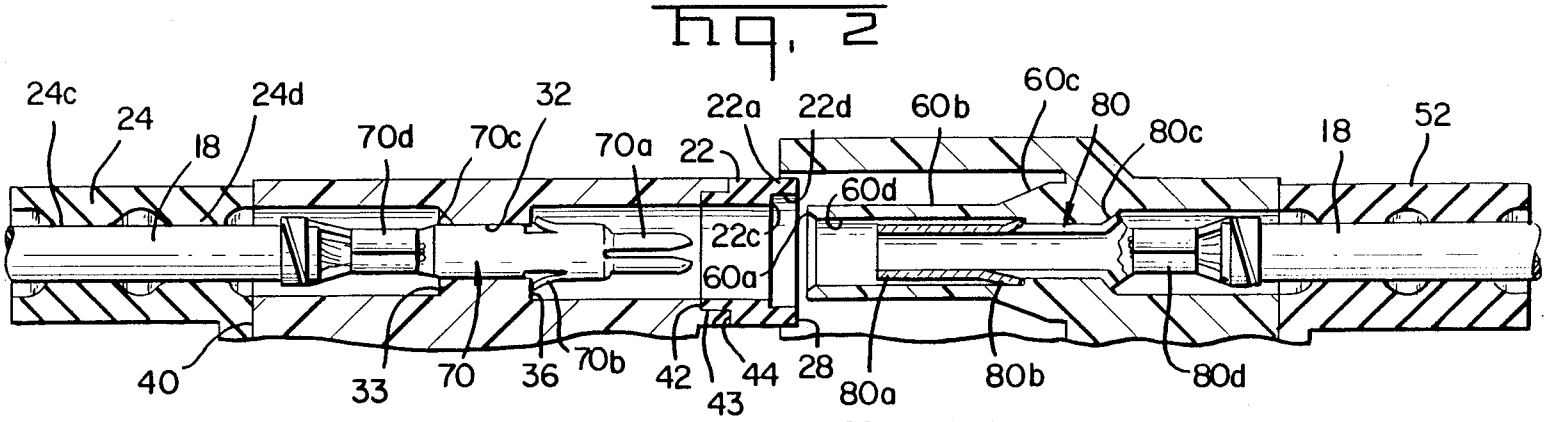
FIG. 2 is a cross sectional view of corresponding terminals positioned within mating portions of two separate housings, with the housings being in alignment prior to mating.

FIG. 1 depicts two mating connector housings 10 and 12 exploded and positioned in alignment. The preferred embodiment depicted herein consists of a four position electrical connector including means for independently sealing the conductors at each position at the rear conductor receiving end of both housings and for providing separate interfacial seal engagement around each terminal at the mating interface.

Plug housing 10 shown in FIG. 1 consists of a single molded member of insulative material including a relatively rigid portion 20 and two relatively more deformable flexible portions 22 and 24 located at the mating end and rearward end respectively. The central portion 20 exhibits sufficient rigidity to retain individual contact terminals 70 and 80 secured within the housing and originally positioned to permit engagement and resist the mating forces between the stamped and formed pin terminal 70 and the stamped and formed socket 80. A number of conventional plastic materials can be employed to fabricate the rigid portion of housing 20. The preferred material for use in fabricating housing 20 is a flame retardant polypropylene. A number of materials suitable for use in fabricating the rigid housing portion 20 are described in U.S. patent application Ser. No. 862,902, filed May 13, 1986 and incorporated herein by reference. Integral latches 26 on opposite sides of the central rigid portion 20 are also integrally molded from the same plastic material as central portion 20. Latch 26 is sufficiently elongate to provide cantilever movement to permit the free end of the latch to move outward for engagement with the receptacle connector and then inward to latch the receptacle connector to the plug connector.

The plug connector housing 10 also includes molded seals 22 and 24 at opposite ends of the central rigid connector housing 10. The connector half 10, although consisting of different sections of different materials is in fact a single or unitary molded member and is not an assembly of separate pieces. The relatively deformable or flexible sealing portions 22 and 24 are adhered to the central rigid body 20 along an interface at which the deformable portions exhibit an adherence by means of a chemical affinity to the rigid portion. The exact nature of this chemical affinity is described in greater detail in U.S. patent application Ser. No. 862,902, filed May 13, 1986, which is incorporated herein by reference. A suitable material for fabricating the deformable sealing members 22 and 24 would be one of several formulations of Santoprene, a dynamic vulcanizate comprising ethylene-propylene-diene-monomer (EPDM) rubber particles dispersed in a matrix of polypropylene. Santoprene is available from Monsanto Polymer Products Company. In the preferred embodiment of this invention, a silicone lubricant is added to the Santoprene material in the manner discussed in the above identified patent application. This material constitutes a flexible elastomer and forms an interface with a rigid surface or with the insulation surrounding a conductor when deformed.

In the preferred embodiment of this invention the forward or interfacial mating seal 22 comprises a single mass of deformable material. For the four position sealed connector depicted herein, a common base **22*b* is formed adjacent the interface with the rigid body 20. A plurality of cylindrical lips 22*a* extend upwardly from the common base 22*b*. The lips 22*a* are free standing and are capable of being outwardly deformed. The deformable lips 22*a* thus extend outwardly along the mating face 28 of connector housing 10 in position to engage the opposite connector half 12 when mated. The interface between the rigid body 20 and seal 22 comprises a three dimensional nonplanar contour in the form of right angle steps defined by surfaces 42, 43 and 44. This three dimensional nonplanar contour provides a greater surface area at the interface between seal 22 and the rigid body 20, thus increasing the adherence of seal 22 to rigid body 20**.

The conductor seal is formed at the rear of the housing 10 by a deformable seal 24 having a plurality of cavities 30 extending therethrough in alignment with cavities 32 in the rigid terminal housing 20. The deformable sealing portion 24 also comprises a single mass of deformable material with four generally cylindrical conductor seals **24*a* interconnected by webs 24*b* extending between the cylindrical seals 24*a***.

Sealing ribs **24*c* and 24*d* are formed on the interior of the seals 24 and extend into sealing cavity 30. Insertion of a conductor through the sealing ribs 24 deforms the sealing ribs relatively outwardly and establishes sealing integrity around the conductor. Seal 24 is formed of the same material as seal 22 and is sufficiently deformable to permit the passage of a terminal through and past the ribs 24*c* and 24*d* and into the cavity 32** of the rigid housing.

A connector receptacle 12 matable with the connector plug 10 is also formed with a relatively rigid body formed of sections 50 and 54 and a relatively deformable sealing portion 52 located at the rear conductor receiving end of the receptacle housing 12. The material forming the relatively rigid and relatively deformable portions of connector receptacle 12 can be the same as for the connector plug 10. The rigid body is divided into two sections by a central flange 56. Both rigid body portions 50 and 54 are formed of the same material as part of the same molding operations. As with the plug housing 10, the relatively rigid portions 50 and 54 and the relatively more deformable portion 52 all constitute a unitary molded member with a chemical affinity being established between the rigid portion 54 and the deformable sealing portion 52 along the interface therebetween. Sealing portion 52 is in all respects analogous to sealing portion 24 on the connector plug 10.

The central flange 56 extends peripherally around the rigid body portion 50, 54. A sealing gasket 58 is adhered to the flange 56 in the same manner as the conductor seals and the interfacial seals are formed, and the gasket 58 forms a part of the one-piece molded connector housing. The formation of sealing gasket 58 occurs at a different time in the molding operation than the formation of flange 56, but the same surface on the mold tooling forms the interfacial surface of flange 56 as forms the free sealing surface of gasket portion 58. In the preferred embodiment peripheral ridges 57 are formed on flange 56 and peripheral sealing ridges 59 having the same contour would be formed by the same surface on the mold tooling. This sealing integrity can be established with a bulkhead when receptacle housing 12 is attached by screws or other conventional fasteners to a bulkhead, wall or partition.

The mating end 51 of the connector receptacle 50 is formed with a plurality of cylindrical protuberances or silos 60 extending from a base adjacent the rigid body portion 54 into a cavity 62 at the mating end 52. Each protuberance 60 has a free end **60*a* with a central bore 60*d* being defined by the cylindrical portion 60*b* of the silo or protuberance. An outwardly expanded conical section 60*c* is located at the base of the cylindrical portion 60*b* of silo 60. This conical portion 60*c* is continuous completely around the cylindrical portion 60*b*. The protuberance bore is conincident with a cavity extending through the rigid portion 54 and subsequently through each of the separate sealing bores providing room for conductor 18 in the seal portion 52**.

The terminals used in plug housing 10 and receptacle housing 12 are conventional. Terminal 70 comprises a crimped pin contact having a male pin leading edge **70*a* and crimped in conventional fashion at 70*d* to a stripped conductor 18. Pin terminal 70 has outwardly projecting lances 70*b* and outwardly projecting abutting surfaces 70*c*. Lances 70*b* are inwardly deflectable to permit insertion of the pin terminal into the cavity 32. Lances 70*b* and shoulder 70*c* abut constricted portions 36 and 33 within the cavity 32 formed in the rigid section of plug housing 10. Outwardly protruding lances 70***b* and shoulder 70*c* can be inserted through the sealing member 24 without significant damages to sealing ribs 24*c* and 24*d*.

Socket terminal 80 mounted in receptacle housing 12 is matable with the pin terminal 70. A cylindrical socket portion 80*a* engages the pin portion 70*a* as shown in FIG. 3 to form a stable electrical connection between conductors 18 extending into the rear of each housing. Socket terminal 80 has outwardly extending lances 80*b* and a shoulder 80*c* which serve the same purpose as lance 70*d* and shoulder 70*c* in the pin terminal 70. A crimp 80*d* of conventional construction interconnects the stamped and formed socket terminal 80 to a stripped conductor 18 in conventional fashion. Other embodiments of this invention might employ a pin terminal in the receptacle housing and a socket terminal in the receptacle housing.

Figure 7:
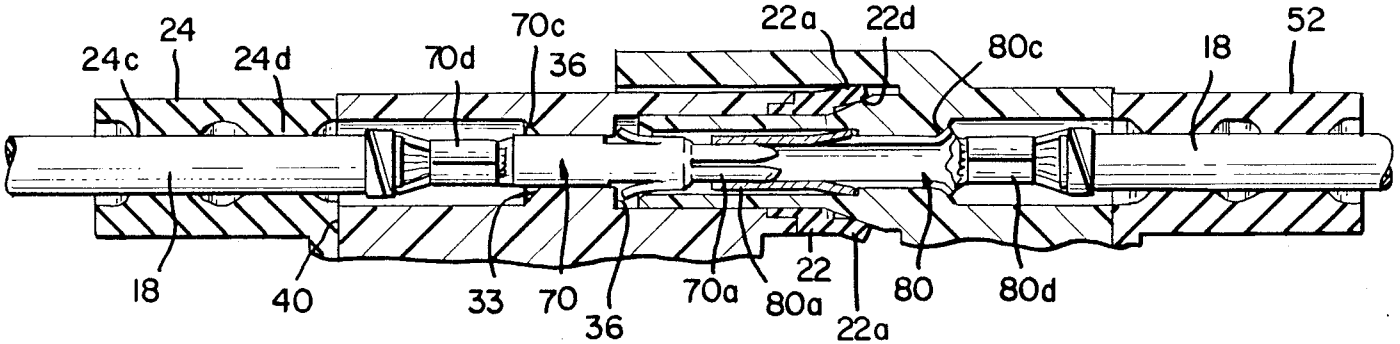
FIG. 7 is an enlarged perspective view, partially in section of the interfacial seals prior to mating.
Figures 4, 5, 6:
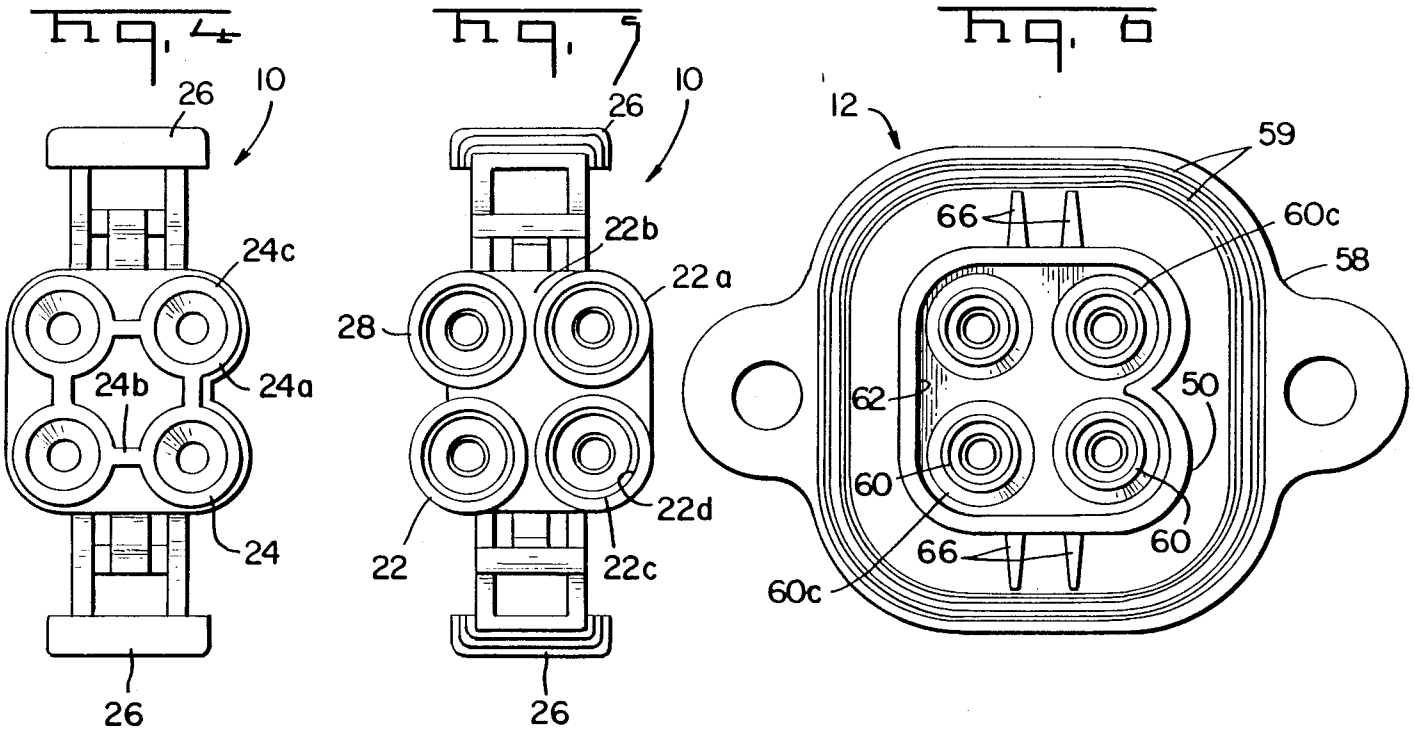
FIG. 4 is an end view of the rear conductor receiving end of the plug, which is similar to the rear conductor receiving end of the receptacle.
FIG. 5 is an end view of the plug housing showing interfacial seals.
FIG. 6 is an end view of the receptacle housing when viewed along line 6—6 showing protruding silos.

FIGS. 3 and 8 demonstrate the manner in which a separate seal connection is formed with corresponding conductors 18 at the rear of the plug and receptacle housings respectively and the manner in which a mating seal is established adjacent the mating face 28 of plug housing 10 and the mating end of receptacle housing 12. The outwardly deformable seal lips 22*a* engage the conical section 60*c* when plug housing 10 is mated with receptacle housing 12. As shown in FIGS. 7 and 8 each individual protuberance 60 is insertable into a cavity in the plug housing 10. The protuberance 60 is also insertable through the bore of the cylindrical sealing lips 22*a*. Two discrete sealing contacts are formed by the edges of the stepped surface of sealing lips 22*a* with the conical surface 60*c*. This sealing engagement is demonstrated schematically in FIG. 8. Note that the sealing lips 22*a* expand outwardly. Deformation of the seals results in the formation of a suitable seal around each protuberance. Sealing integrity for the outwardly deflected cylindrical sealing lips 22*a* is not dependent upon the precise axial position of the sealing lips 22*a* relative to conical surface 60*c*. Sealing integrity is first established soon after the interior of the sealing lips 22*a* engages conical surface 60*c*. Continued axial movement of plug housing 10 relative to the receptacle housing 12 results in continued expansion of the cylindrical seals 22*a* along the conical surface 60*c*. The cylindrical configuration of the seals permits a relatively large axial movement, and the tolerances of other elements on the housing do not become excessively tight. For example, unrealistically close tolerances for latch 26 and latching ears 66 are not necessary, because precise positioning of the seal 22 and the conical surfaces 60*c* are not essential.

Figure 9:
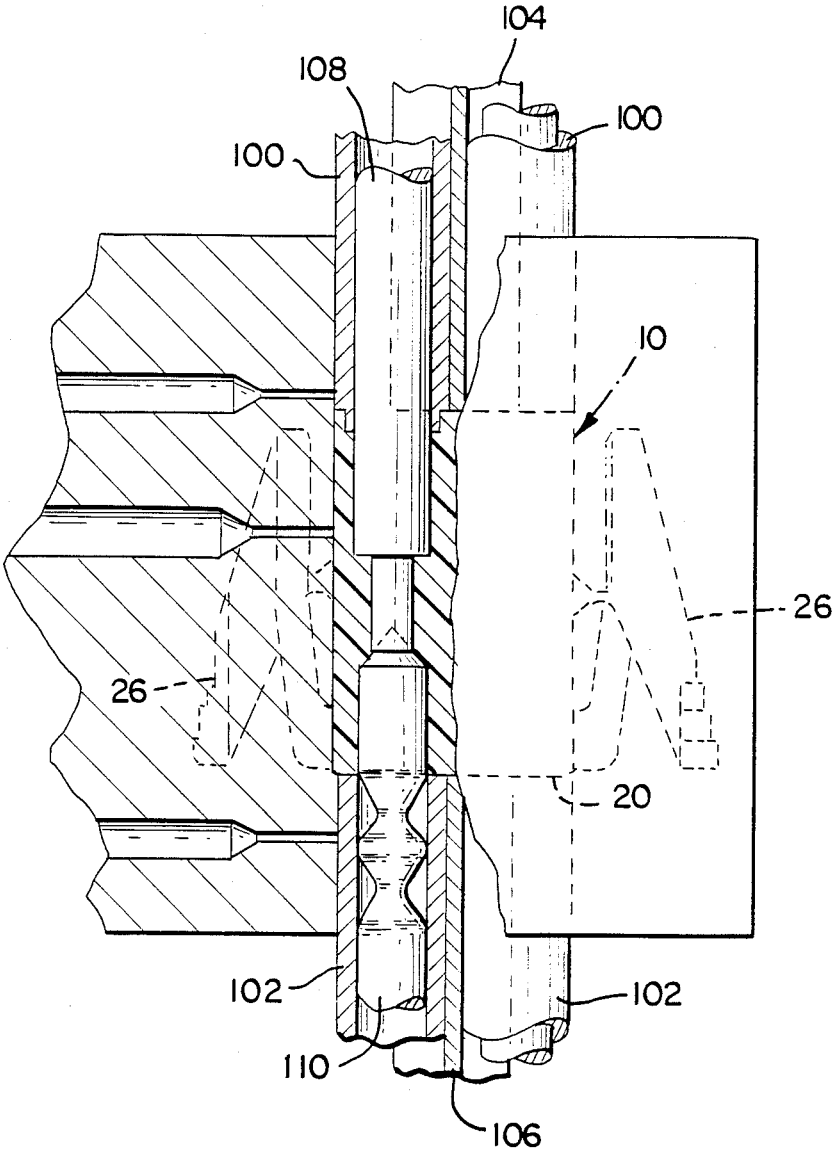
FIG. 9 is a view partially in section showing the molding of the rigid portion of a single housing.
Figure 10:
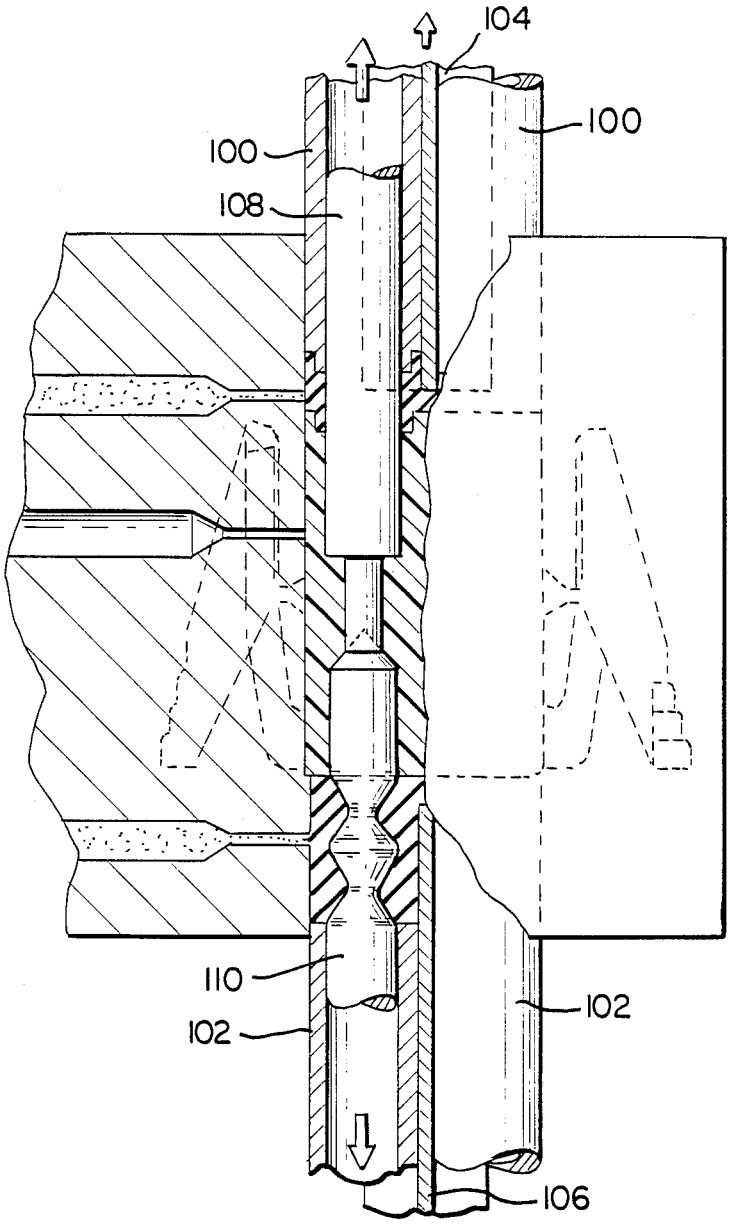
FIG. 10 is a view partially in section showing the molding of the relatively deformable sealing members on opposite ends of the housing.
Figure 11:
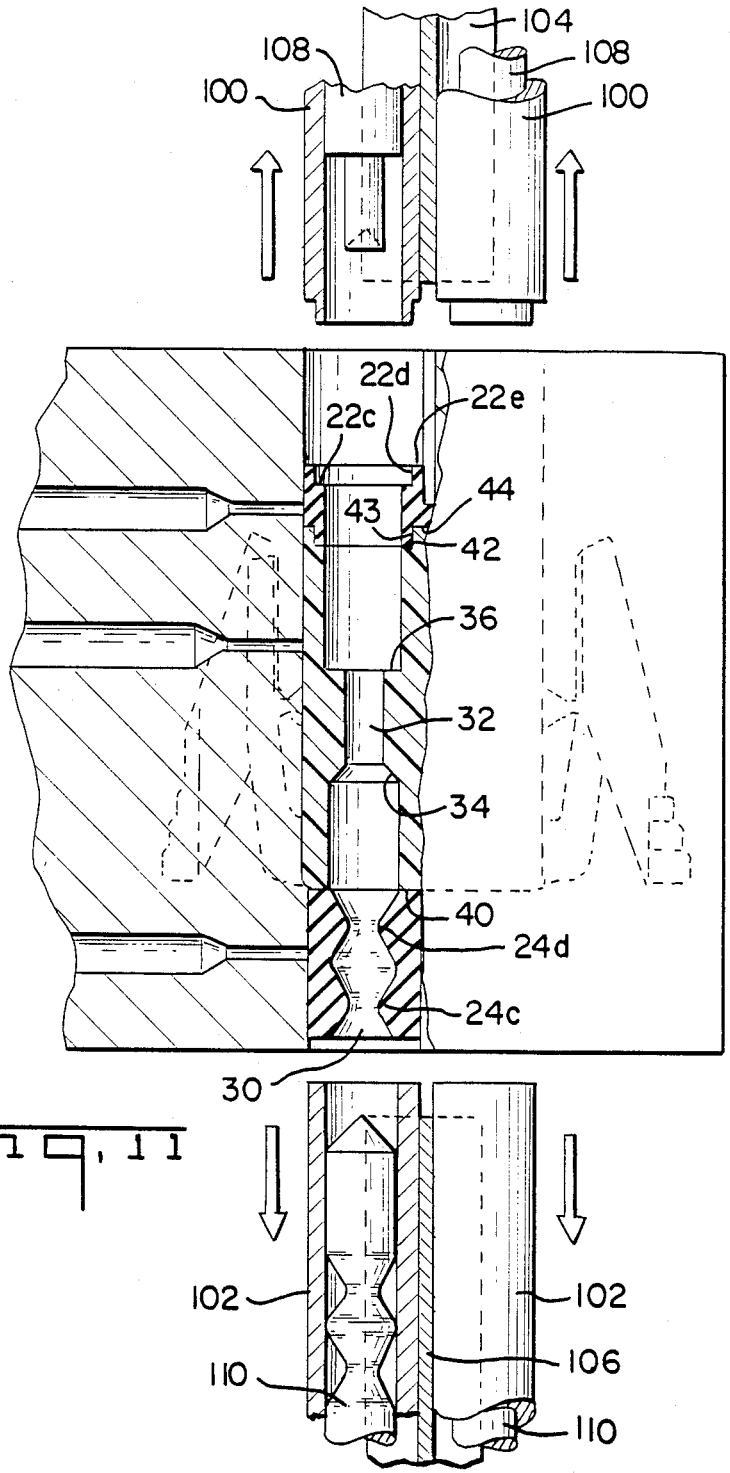
FIG. 11 is a view partially in section showing withdrawal of the core pins from a single housing cavity.
Figure 17:
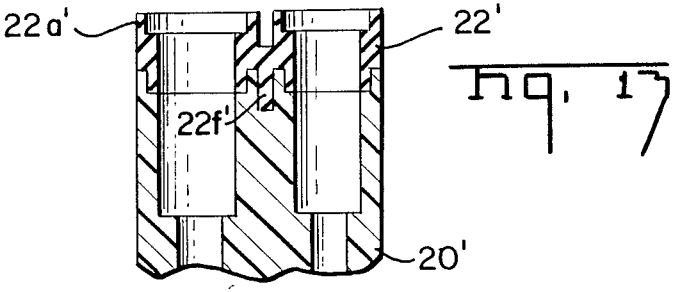

FIGS. 9 through 11 demonstrate the manner in which the connector housing 10 is formed as a unitary insulative body in a dual molding process in which two separate materials are used to form the body. As shown in FIG. 9 the relatively rigid material is injected into a mold to form the rigid body portion 20, including latches 26. Axially shiftable sleeves 100, 102 and pin 104 are then withdrawn defining an additional cavity at the opposite ends of the rigid body portion. Elastomeric material can then be injected into this additional cavity and a chemical affinity will be established at the interface between the rigid body portion and the deformable portions 22 and 24. Note that the temperature of the rigid body portion 20 and sealing members 22 and 24 are elevated at the time this chemical affinity is established. Note that seal 22 is cylindrical in nature and can be formed by straight draw core pins without the need of complex coring to form laterally extending lips. It is this need to simplify the manufacture and construction of sealing member 22 that requires the use of outward deformation of the cylindrical seal upon engagement with the conical surface on the protuberance as the basic sealing mechanism of this connector. Note that the free end of the cylindrical sealing lips 22*a* has the same contour as the interface between the rigid portion 20 and the deformable portion 22. The three dimensional nonplanar contour formed by seal surfaces 22*c*, 22*d* and 22*e* is the same as the three dimensional nonplanar contour formed by surfaces 42, 43 and 44. This identity follows from the fact that each contour is formed by the same core pin. This stepped contour not only increases the surface area for the interface between the rigid and deformable housing portions, but also defines the two distinct sealing lips which engage conical surface 60*c*. FIG. 11 shows the withdrawal of the core pins 108, 110 used to define the cavities extending through the rigid body portion 20. Note that ribs 24*c* and 24*d* are sufficiently flexible to deform upon withdrawal of the core pin which has constricted portions to form ribs 24*c* and 24*d*.

Figure 12:
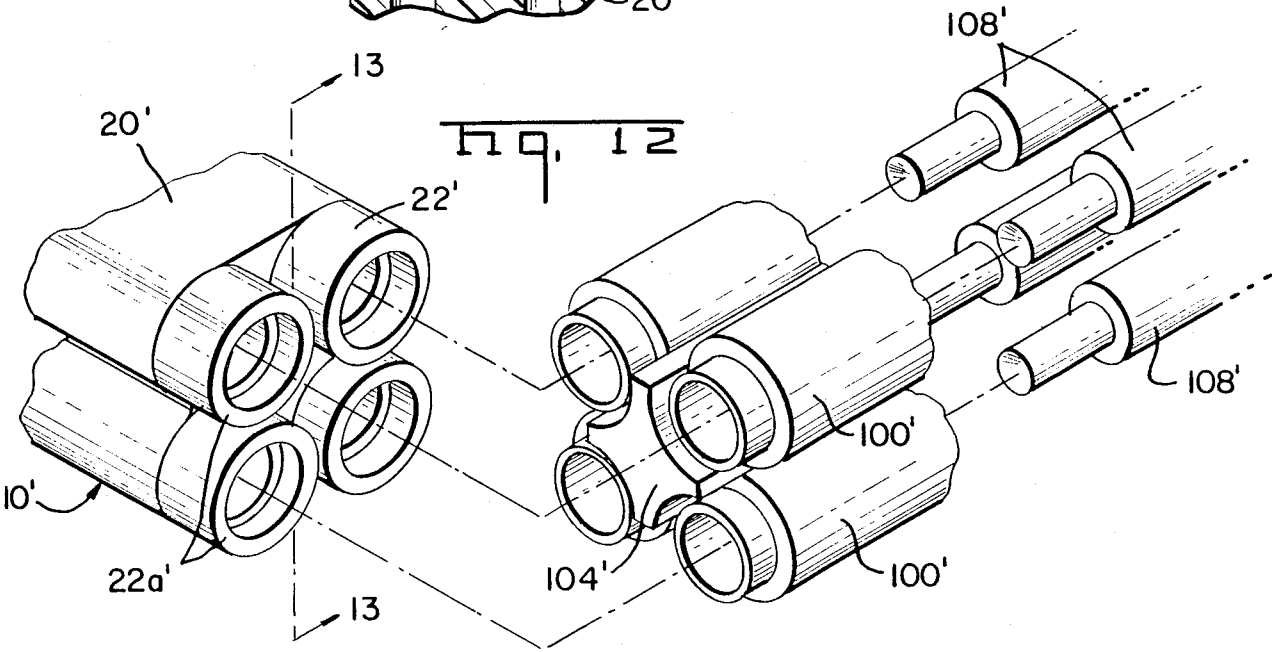
FIG. 12 is a schematic of an alternate embodiment of the interfacial seals and the tooling used to fabricate the molded interfacial seals.

FIGS. 12 and 13 show the manner in which an alternate embodiment of the present invention can be fabricated using simpler mold tooling than that shown in FIGS. 9–11. Primed reference numerals generally correspond to similar structures in the embodiment of FIGS. 1–11. FIG. 12 shows the mating end of a one-piece plug connector housing 10' having an interfacial seal 22 adhered to a rigid body portion 20'. Independent deformable sealing lips 22*a'* are formed on the one-piece seal member 22' in the same manner as for the embodiment of FIGS. 1–11. The contour of the interface between the deformable seal portion 22' and the relatively rigid body portion 20' differs from that in the other embodiment. A projecting rib 22*f'*, having no counterpart in the other embodiment, is shown in FIG. 13. This projecting rib 22*f'* of the sealing portion 22' extends into a corresponding recess in the rigid body portion 20'. Significantly the contour of the outer end of sealing portion 22' matches the contour of the interfacial surface between the seal 22' and the rigid body portion 20'. These corresponding contours are again due to the fact that the same surface on the movable core pin assembly is responsible for sequentially molding each surface. This core pin assembly consists of cylindrical sleeves 100' and a central segment 104'. Unlike the tooling used with the embodiment of FIGS. 1–11, the central segment 104' is not movable relative to cylindrical sleeves 100'. The entire assembly moves at once and preferably can be formed from a single piece of metal. Core pins 108' move through sleeves 100' in the same manner as in the preferred embodiment.

The rib 22*f'* does increase the surface area along which the seal 22' is joined to the rigid body portion 20'. This feature is secondary, however, and the formation of rib 22*f'* is primarily due to the fact that the contour of the free end should preferably define four independently expandable sealing lips 22*f'*. One skilled in the art would appreciate that a gap must be defined between each sealing lip, thus requiring the central segment 104' to extend beyond the cylindrical sleeves 100' of the tooling.

What is claimed:

1. A detachable sealed electrical connector for use in establishing a sealed interconnection between conductors in one or more circuits comprising:

first and second matable connector housings, the first housing comprising a unitary molded member having a relatively rigid portion and a relatively deformable sealing portion extending from an end of the rigid portion on a mating face of the first housing:

at least one relatively rigid protuberance on a mating end of the second housing, a bore in the second housing extending through the protuberance;

at least one cavity extending through the first connector housing, a first portion of the cavity extending through the relatively rigid portion only a second portion of the cavity extending through the relatively deformable sealing portion only and comprising means for receiving a corresponding protuberance; and matable electrical terminals in corresponding bores and cavities, whereby the relatively flexible sealing portion is outwardly deflectable to establish sealing integrity around a corresponding protuberance when the first and second connector housings are mated.

2. The electrical connector of claim 1 further comprising second relatively deformable sealing portions on a rear end of the first and second housing, the second relatively deformable portions comprising means for sealing a conductor after insertion of one of the electrical terminals therethrough.

3. The electrical connector of claim 1 wherein the relatively rigid portion and the relatively deformable portion are formed of different insulative materials joined together at the interface by a chemical affinity therebetween.

4. The electrical connector of claim 1 wherein the relatively deformable portion formed of an elastomeric material.

5. The electrical connector of claim 1 further comprising a rigid molded flange extending from the relatively rigid portion of one connector housing and a peripheral molded sealing gasket on one surface of the flange, the flange and the sealing gasket each being part of the one unitary molded connector housing.

6. The electrical connector of claim 1 wherein each protuberance has a free end adjacent the mating end of the second housing and a base, the base having a conical contour, the relatively deformable sealing portion of the first housing being at least partially outwardly expandable upon engagement with the conical contour of the protuberance base.

7. The electrical connector of claim 6 wherein the sealing portion comprises a cylindrical lip extending outwardly from the mating face of the first housing.

8. The electrical connector of claim 7 wherein the cylindrical lip has a free end with a stepped contour comprising means for forming plural discrete sealing contacts upon engagement with the conical surface.

9. The electrical connector of claim 7 wherein a plurality of protuberances are positioned side by side on the mating end of the second housing.

10. The electrical connector of claim 9 wherein a plurality of separate lips are positioned on the mating face of the first housing oriented in alignment with corresponding protuberances.

11. The electrical connector of claim 10 wherein the separate lips each have a free end spaced from the relatively rigid portions, the lips being mutually joined by an interconnecting web to form a single continuous member formed of the same relatively deformable insulative material.

* * * * *